US005201588A

United States Patent [19]

Sakai et al.

[11] Patent Number: 5,201,588

[45] Date of Patent: Apr. 13, 1993

[54] PRINTER WITH OPENABLE PAPER WEB CASSETTE MOUNTING A PLATEN ROLLER

[75] Inventors: Katsuyuki Sakai, Nara; Kenichi Shiraishi; Shigeru Kida, both of Yamatokoriyama; Ryoichi Kawai, Kitakatsuragi, all of Japan

[73] Assignee: Sharp Kabushiki Kaisha, Osaka, Japan

[21] Appl. No.: 857,769

[22] Filed: Mar. 26, 1992

[30] Foreign Application Priority Data

Mar. 27, 1991 [JP] Japan ..... 3-63473

[51] Int. Cl.[5] ..... B41J 3/02

[52] U.S. Cl. ..... 400/120; 400/613; 400/663; 400/693; 346/136; 346/76 PH

[58] Field of Search ..... 400/120, 611, 613, 613.1, 400/693, 693.1, 663; 346/136, 76 PH; 358/296

[56] References Cited

U.S. PATENT DOCUMENTS

| | | | |
|---|---|---|---|
| 3,682,407 | 8/1972 | Lichtenstein et al. | 400/613 |
| 4,445,647 | 5/1984 | Deeg et al. | 400/613 |
| 4,641,980 | 2/1987 | Matsumoto et al. | 400/120 |
| 4,663,638 | 5/1987 | Hirose | 346/136 |
| 4,860,031 | 8/1989 | Lejcek | 346/136 |
| 4,868,676 | 9/1989 | Matsuura | 358/296 |
| 4,910,602 | 3/1990 | Sakuragi | 358/296 |
| 5,060,076 | 10/1991 | Curley | 400/613 |
| 5,092,688 | 3/1992 | Haennelt et al. | 400/120 |

FOREIGN PATENT DOCUMENTS

| | | | |
|---|---|---|---|
| 0372753 | 11/1989 | European Pat. Off. . | |
| 57075880 | 10/1980 | Japan . | |
| 0148783 | 9/1983 | Japan | 400/613 |
| 0198169 | 11/1984 | Japan | 400/613 |
| 0115471 | 6/1985 | Japan | 400/613 |
| 0187575 | 9/1985 | Japan | 400/613 |
| 60-168952 | 11/1985 | Japan . | |
| 62-159565 | 7/1987 | Japan . | |
| 0084960 | 4/1988 | Japan | 400/120 MP |
| 0199669 | 8/1988 | Japan | 400/613 |

*Primary Examiner*—Eugene H. Eickholt

*Attorney, Agent, or Firm*—David G. Conlin; Donald R. Castle

[57] ABSTRACT

A printer in which a rolled recording paper is housed in a recording paper cassette formed integrally with a printer proper and openably with respect thereto, and one of a thermal recording head or a platen roller is disposed at an openable free end of the cassette with the other disposed in the printer proper, whereby printing onto the recording paper is effected by conducting electrical current to the recording head while the recording paper being clamped by the recording head and platen roller.

3 Claims, 5 Drawing Sheets

PRINTER WITH OPENABLE PAPER WEB CASSETTE MOUNTING A PLATEN ROLLER

BACKGROUND OF THE INVENTION

1. Field of the Invention

The present invention relates to a printer for printing a recording paper (web) which is sandwiched in between a thermal recording head and a platen roller and clamped together thereby.

2. Description of the Prior Art

In a conventional printer of this type as exemplified in FIG. 1, a thermal head 16 and a platen roller 15 both supported by a head frame 17 are arranged in a printer proper 30 while being pressed together, and a recording paper cassette 11 for housing a recording paper 40 is disposed at an end of the printer proper 30. The mutually pressed state of the thermal recording head 16 and platen roller 15 can be released by causing a push-up member 12*a* of a release cam 12 integrally mounted on a rotary shaft 14 of the platen roller 15 to push up the head frame 17, and the push-up operation of the release cam 12 can be carried out when the user of the printer rotates a pressing release lever 13 in a direction of El.

When setting the recording paper 40 in the printer, the recording paper 40 is passed through a gap between the thermal recording head 16 now raised by the push-up member 12*a* of the release cam 12 and the platen roller 15 while keeping the recording paper cassette 11 opened, as shown in FIG. 2, and thereafter the recording paper cassette 11 is closed and the pressing release lever 13 is rotated in a direction of E2 so that as shown in FIG. 1 the recording paper 40 may be clamped by the thermal recording head 16 and platen roller 15, thus completing setting of the recording paper 40.

With the above conventional construction, however, upon setting of the recording paper 40 in the printer, the user of the printer is required to release the mutually pressed state of the thermal recording head 16 and platen roller 15 by operating the pressing release lever 13 and to pass the recording paper 40 through the small gap between the thermal recording head 16 and platen roller 15, raising a problem that the user of the printer is forced to attend to the aforementioned troublesome operation.

SUMMARY OF THE INVENTION

The present invention contemplates elimination of the above drawback and its object is to provide a printer which can permit the recording paper to be automatically set in the printer concomitantly with closing operation of the recording paper cassette, whereby the user of the printer can be freed from the troublesome setting operation of the recording paper.

According to the invention, to accomplish the above object in a printer in which a rolled recording paper is housed in a recording paper cassette and printing onto the recording paper is carried out by conducting electrical current to a thermal recording head while the recording paper being clamped between the thermal recording head and a platen roller, the recording paper cassette is formed integrally with a printer proper and openably with respect thereto, an openable free end of the recording paper cassette is mounted with one of the thermal recording head or platen roller, and the other is disposed in the printer proper.

With the above construction wherein the recording paper cassette is formed integrally with the printer proper and openably with respect thereto and one of the platen roller or thermal recording head is mounted to the openable free end of the recording paper cassette, upon setting of the recording paper in the printer, the recording paper can automatically be clamped by the platen roller and thermal recording head concomitantly with closing operation of the recording paper cassette.

In the above printer, by mounting the platen roller to the openable free end of the recording paper cassette and disposing the thermal recording head in the printer proper, rigidity of mounting of the thermal recording head to the printer can be improved, giving rise to attainment of a stable mutually pressed state of the platen roller and thermal recording head.

Further, in the above printer, by using the rotary shaft of the platen roller as a shaft for locking the mutually pressed state of the platen roller and thermal recording head, the pressing position of the platen roller against the thermal recording head can be controlled to a fixed position.

Furthermore, in the above printer, when a lock release lever constituting a mechanism for locking the rotary shaft of the platen roller is mounted to a head frame for supporting the thermal recording head, positioning of the platen roller and thermal recording head can be carried out directly by means of the lock release lever to further stabilize the mutually pressed state of the platen roller and thermal recording head.

DESCRIPTION OF THE PREFERRED EMBODIMENTS

Referring now to FIGS. 3 to 8, an embodiment of the invention will be described. FIGS. 3 to 8 show, in longitudinal sectional form, a printer of the present embodiment with the depth thereof directed in a direction orthogonal to the sheet of drawing and for convenience of explanation, this direction is hereinafter referred to as a width direction of the printer.

Figure 1:
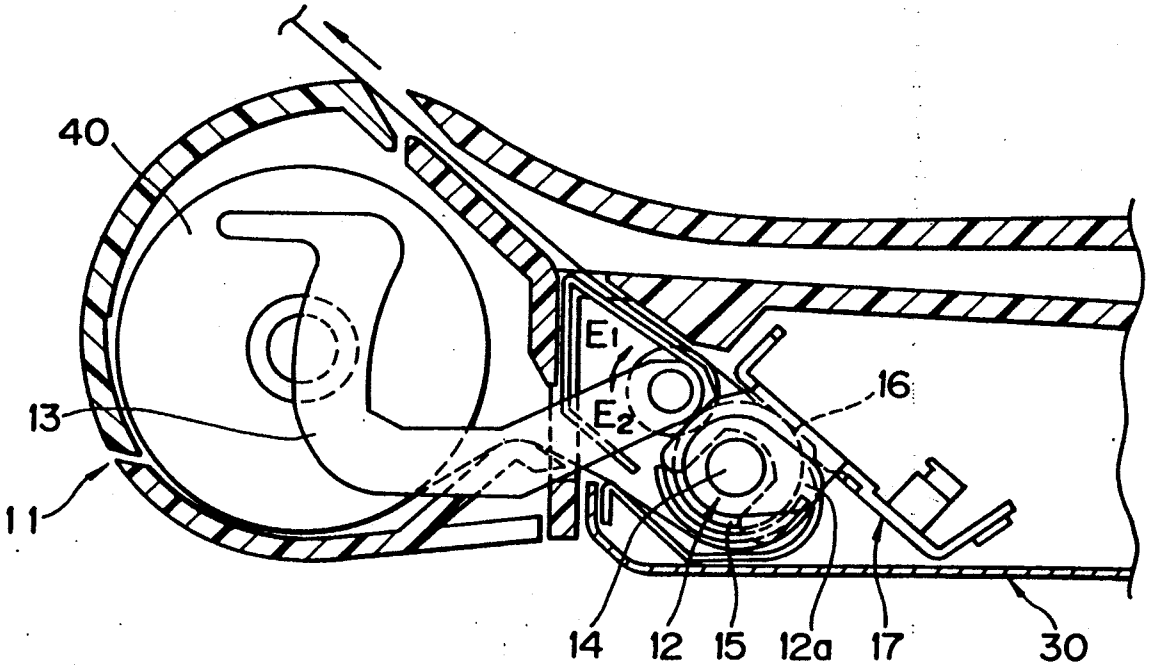
FIG. 1 is a longitudinal sectional view showing the closed state of a recording paper cassette constituting a prior art printer.
Figure 2:
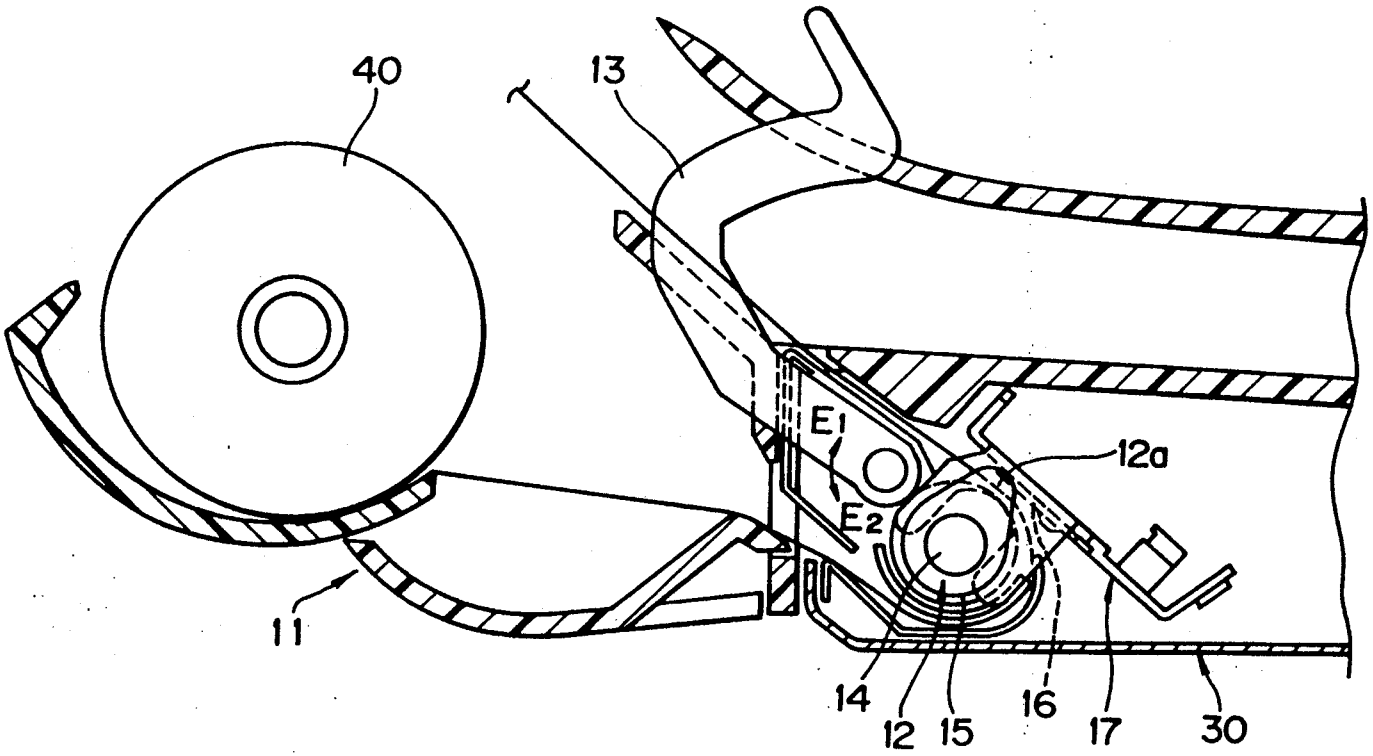
FIG. 2 is a longitudinal sectional view showing the opened state of the recording paper cassette.
Figure 3:
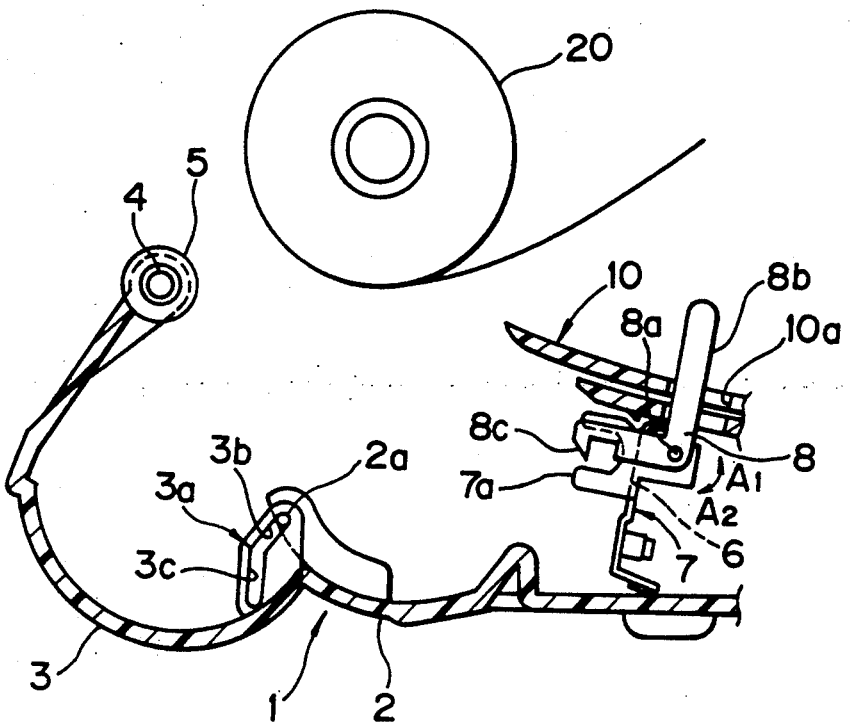
FIG. 3 is a longitudinal sectional view showing the opened state of a recording paper cassette constituting a printer of the invention.

As shown in FIG. 3, the printer according to the present embodiment has a recording paper cassette 1 for housing a rolled recording paper (web) 20, which cassette is formed integrally with a printer proper 10.

The recording paper cassette 1 includes a stationary part 2 and a movable part 3. The stationary part 2 has its one end side fixed to the printer proper 10 and the other end side having opposite ends in the width direction formed with engagement projections 2a.2a which engage guide slots 3a.3a formed in the movable part 3 as will be detailed later (in the figure, only one engagement projection 2a at one end in the width direction of the printer is depicted).

The movable part 3 is formed into a shape in which the rolled recording paper 20 can be loosely fitted and has its one end side having opposite ends in the width direction formed with the guide slots 3a.3a (in the figure, only one guide slot 3a at one end in the width direction of the printer is depicted). The guide slot 3a is bent midway to take a t-shape and includes a first linear slit 3b and a second linear slit 3c. With the engagement projections 2a.2a brought into engagement with the guide slots 3a.3a, the movable part 3 is so supported by the stationary part 2 as to be movable in the open/close direction of the recording paper cassette 1. The movable part 3 has its one end side supported by the stationary part 2 and the other openable free end side which supports a roller shaft 4 acting as a rotary shaft extending in the width direction. A platen roller 5 is jounalled on the roller shaft 4.

On the other hand, the printer proper 10 has a head frame 7 which supports a thermal recording head 6 extending in the width direction of the printer and the head frame 7 has at its opposite ends in the width direction lugs 7a.7a for receiving and supporting opposite ends in the width direction of the roller shaft 4 upon closure of the recording paper cassette 1 (in the figure, only one lug 7a at one end in the printer width direction illustrated). Lock release levers 8 are mounted to the opposite ends in the width direction of the head frame 7.

The lock release lever 8 is bent to take a t-shape and supported at its bent portion 8a on the head frame 7 so as to be rotatable in A1–A2 directions. The lock release lever 8 has one end passing through an insertion hole 10a formed in the printer proper 10 to form an operating handle 8b for lock release and the other end forming an engagement pawl 8c engageable with the roller shaft 4 provided to the movable part 3. The lock release lever 8 is normally urged to rotate in the Al direction by means of a spring member, not shown, and upon closure of the recording paper cassette 1, the engagement pawl 8c engages the roller shaft 4 to position and fix the mutually pressed state of the platen roller 5 and thermal recording head 6 but upon opening of the recording paper cassette 1, the operation handle 8b is operated by the user of the printer so as to be rotated in the A2 direction, thus releasing the engagement of the engagement pawl 8c with the roller shaft 4.

With the above construction, the process of setting the recording paper 20 in the printer is carried out as will be described below.

Figure 4:
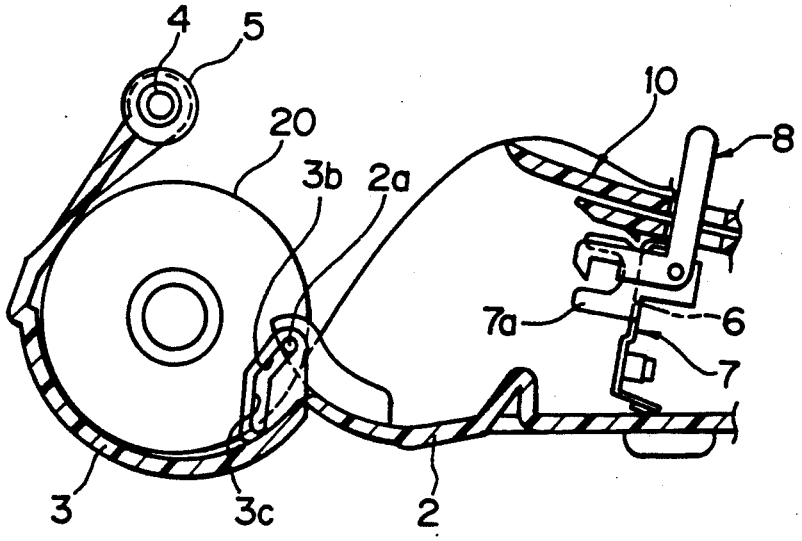
FIG. 4 is a longitudinal sectional view showing the state of a recording paper charged in the opened recording paper cassette.

Firstly, as shown in FIG. 3, the movable part 3 of the recording paper cassette 1 is opened and subsequently, as shown in FIG. 4, a rolled recording paper 20 is loosely fitted in the movable part 3. At that time, the fore end of the recording paper 20 loosely fitted in the movable part 3 is paid out to overlie the top surface of the printer proper 10.

Figure 5:
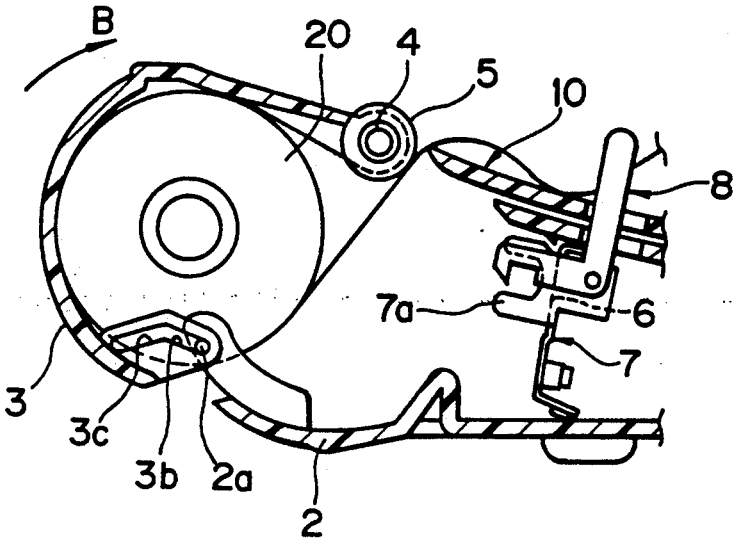
FIG. 5 is a longitudinal sectional view showing rotational operation of a movable part constituting the recording paper cassette.
Figure 6:
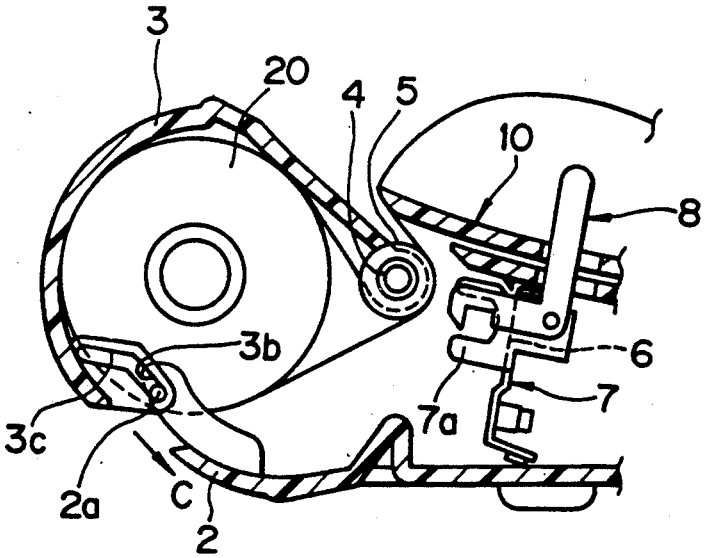
FIG. 6 is a longitudinal sectional view showing slide operation of the movable part due to engagement of a first linear slit of the movable part with an engagement projection of a stationary part.

Thereafter, as shown in FIG. 5, the movable part 3 along with the recording paper 20 loosely fitted therein in the manner described previously is rotated in a direction of B about the engagement projection 2a of the stationary part 2. As the movable part 3 rotates, the platen roller 5 provided at the openable free end of the movable part 3 is moved into the printer proper 10 while entraining the recording paper 20, as shown in FIG. 6.

Figure 7:
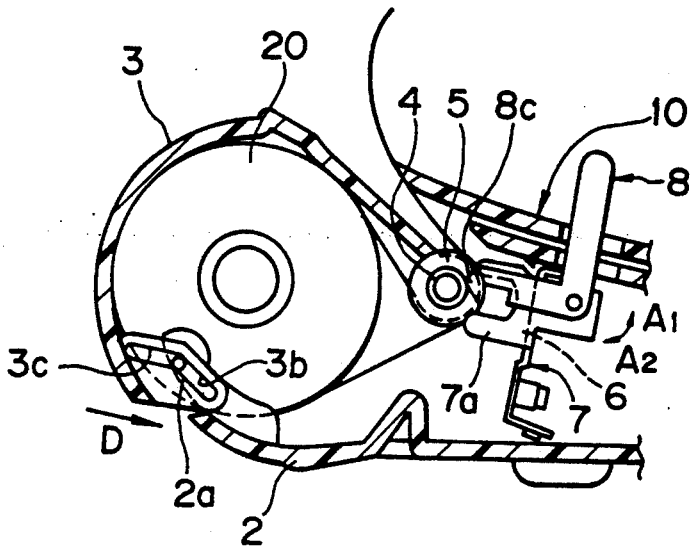
FIG. 7 is a longitudinal sectional view showing slide operation of the movable part due to engagement of a second linear slit of the movable part with the engagement projection of the stationary part.

As the platen roller 5 moves into the printer proper 10 as described above, the engagement projection 2a in engagement with the first linear slit 3b of the guide slot 3a slides the movable part 3 in a direction of C, i.e., in the longitudinal direction of the first linear slit 3b, causing the roller shaft 4 to bear against the engagement pawl 8c of the lock release lever 8, as shown in FIG. 7.

Figure 8:
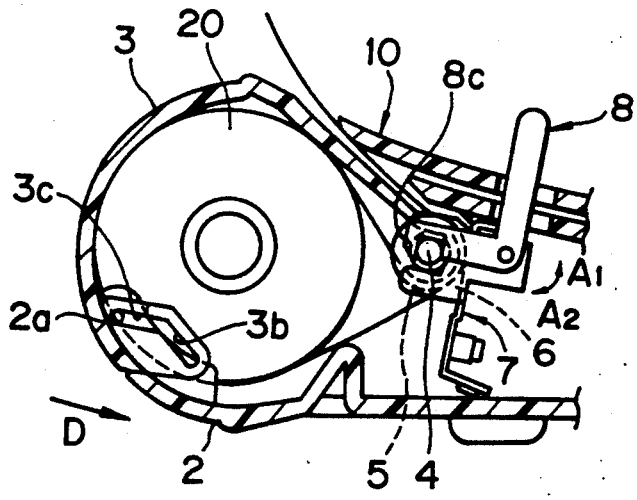
FIG. 8 is a longitudinal sectional view showing the closed state of the recording paper cassette.

Then, the engagement projection 2a engages the second linear slit 3c of the guide slot 3a to slide the movable part 3 in a direction of D, i.e., in the longitudinal direction of the second linear slit 3c. As a result, the roller shaft 4 is brought into engagement with the engagement pawl 8c of the lock release lever 8 and locked, as shown in FIG. 8, so that the recording paper is clamped by the platen roller 5 and thermal recording head 6, thus completing setting of the recording paper 20 in the printer. Printing onto the recording paper 20 thus clamped by the platen roller 5 and thermal recording head 6 in the aforementioned manner can be effected by conducting electrical current to the thermal recording head 6.

As described above, in the printer according to the present embodiment, the recording paper cassette 1 is formed integrally with the printer proper 10 and openably with respect thereto, the platen roller 5 is disposed at the openable free end of the movable part 3 constituting the recording paper cassette 1, and the thermal recording head 6 is disposed in the printer proper 10. Through this, setting of the recording paper 20 in the printer can automatically be effected concomitantly with moving operation of the movable part 3 during the closure of the recording paper cassette 1.

The roller shaft 4 also serving as the rotary shaft of the platen roller 5 cooperates with the lock release lever 8 provided to the head frame 7 for support of the thermal recording head 6 to constitute a lock mechanism. Therefore, a stable mutually pressed state of the platen roller 5 and thermal recording head 6 can be obtained.

As described above, in the printer of the invention, the recording paper cassette i formed integrally with the printer proper and openably with respect thereto, having its openable free end mounted with one of the thermal recording head and platen roller and the other end connected to the printer proper. Through this, setting of the recording paper in the printer proper can automatically be effected concomitantly with closing operation of the recording paper cassette and advantageously the user of the printer can be freed from the troublesome setting operation of the recording paper.

Particularly, when the platen roller on the one hand is disposed on openable free end of the recording paper cassette and the thermal recording head on the other hand is disposed in the printer proper, rigidity of mounting of the thermal recording head to the printer can be improved, giving rise to attainment of a stable mutually pressed state of the platen roller and thermal recording head to advantage.

Further, when the rotary shaft of the platen roller is brought into engagement with the lock release lever so as to be positioned and fixed with respect to the thermal recording head, the platen roller can be so controlled as to be pressed against the thermal recording head at a fixed position, giving rise to improved printing quality to advantage.

Furthermore, when the lock release lever is supported by the head frame for support of the thermal recording head, positioning of the platen roller and thermal recording head can be carried out directly, thereby further stabilizing the mutually pressed state of the platen roller and thermal recording head.

What is claimed is:

1. A printer in which a rolled recording paper is housed in a recording paper cassette and printing onto the recording paper is carried out by conducting electrical current to a thermal recording head while the recording paper being clamped by the thermal recording head and a platen roller, wherein the recording paper cassette is formed integrally with a printer proper and openably with respect thereto, an openable free end of the recording paper cassette is mounted with the platen roller and the thermal recording head is disposed in said printer proper.

2. A printer in which a rolled recording paper is housed in a recording paper cassette and printing onto the recording paper is carried out by conducting electrical current to a thermal recording ahead while the recording paper being clamped by said thermal head and a platen roller, wherein said recording paper cassette is formed integrally with a printer proper and openably with respect thereto, an openable free end of said recording paper cassette is mounted with said platen roller, and said thermal recording head is disposed in said printer proper, wherein said platen roller has its rotary shaft brought into engagement with a lock release lever so as to be positioned and fixed with respect to said thermal recording head.

3. A printer in which a rolled recording paper is housed in a recording paper cassette and printing onto the recording paper is carried out by conducting electrical current to a thermal recording head while the recording paper being clamped by said thermal head and a platen roller, wherein said recording paper is formed integrally with a printer proper and openably with respect thereto, an openable free end of said recording paper cassette is mounted with said platen roller, and said thermal recording head is disposed in said printer proper, wherein said platen roller has its rotary shaft brought into engagement with a lock release lever so as to be positioned and fixed with respect to said thermal recording head, wherein said lock release lever is supported by a frame head for support of said thermal head.

* * * * *